United States Patent [19]

Erber et al.

[11] Patent Number: 4,953,354

[45] Date of Patent: Sep. 4, 1990

[54] THERMALLY INSULATED STIRLING ENGINE-HOT GAS HEATER SYSTEM COMBINATION

[75] Inventors: Anton Erber, Mühlhausen; Heinz Hoff, Königsbrunn; Günter Reuchlein, Augsburg; Hanno Schaaf, Friedberg; Gerhard Schiessl, Augsburg, all of Fed. Rep. of Germany

[73] Assignee: MAN Technologie GmbH, Munich, Fed. Rep. of Germany

[21] Appl. No.: 269,639

[22] Filed: Nov. 10, 1988

[30] Foreign Application Priority Data

Nov. 25, 1987 [DE] Fed. Rep. of Germany ..... 3739926
Feb. 26, 1988 [DE] Fed. Rep. of Germany ..... 3806114

[51] Int. Cl.[5] ..... F02G 1/04

[52] U.S. Cl. ..... 60/517; 165/76; 165/135

[58] Field of Search ..... 60/517; 165/76, 135, 165/905

[56] References Cited

U.S. PATENT DOCUMENTS 3,540,934 7/1967 Boeke .
3,811,272 5/1974 Hakansson .
3,822,552 7/1974 Palmgren .
3,852,961 12/1974 Salomonsson et al. .
3,878,681 4/1975 Hakansson .

FOREIGN PATENT DOCUMENTS 2651547 5/1977 Fed. Rep. of Germany .
3444995 6/1985 Fed. Rep. of Germany .
1394033 5/1975 United Kingdom .
1447929 9/1976 United Kingdom .
1464084 2/1977 United Kingdom .

*Primary Examiner*—Allen M. Ostrager
*Attorney, Agent, or Firm*—Frishauf, Holtz, Goodman & Woodward

[57] ABSTRACT

A thermally insulating lining for the housing of a heater system for a Stirling, or hot air engine ensures that only safe temperature will be reached on the outside of the heater system. The insulating lining is arranged in two parts. An insulating wall is made up of individually adjacently placed, replaceable insulating elements in the form of ceramic tiles, and/or ceramic tubes, and an intermediate space between the tiles and the outer wall. The intermediate space is separated, if desired, from the insulating elements by a ceramic paper. The intermediate space is packed with ceramic fiber batts, or loose, lump ceramic insulating material.

20 Claims, 7 Drawing Sheets

1/6

1/7
2
14
12
10
20
11
13
8
9
21
19
3
7
5
6
4
6/1
3/1
3/2
III
III
21
19
21
8
9
12
14
20
11
10
14
13

10
14
20
19
18
16
22
21
17
15
12

VI
10
14
16
19
18
17
20
15
11

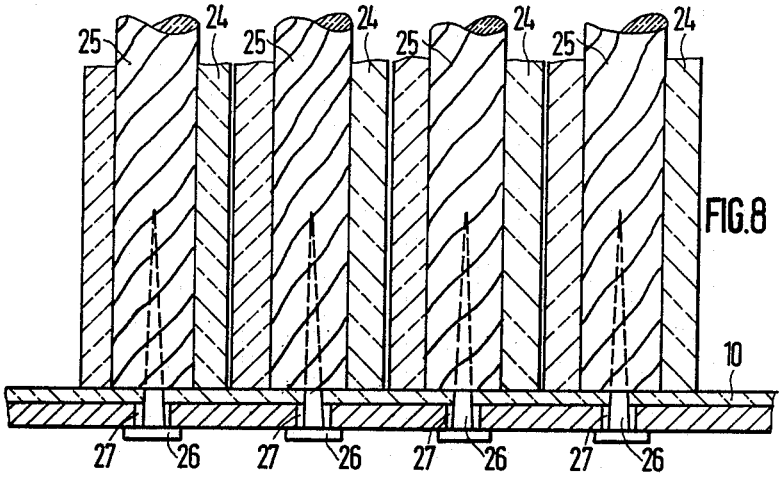
FIG.8
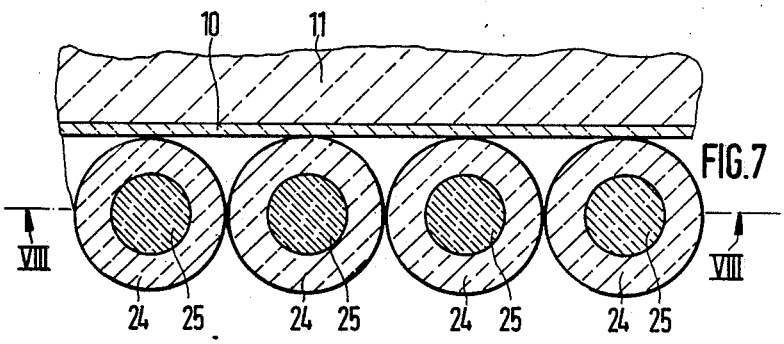
FIG.7
FIG.9
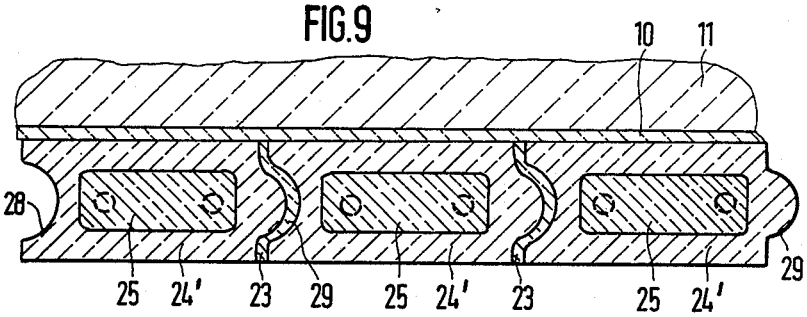

THERMALLY INSULATED STIRLING ENGINE-HOT GAS HEATER SYSTEM COMBINATION

FIELD OF THE INVENTION

The invention relates to a hot gas or Stirling engine combined with a hot gas heater system whose housing, spatially separated from the outside by an external wall, has a thermally insulating lining.

BACKGROUND

A thermally insulating ling for the housing of a heater system has been proposed in which the heater space is provided with an insulating firebrick lining directly adjoining the outer wall of the housing. Such wall linings have however not proved to be suitable in all cases, because the thermal insulating effect is not sufficient to prevent the escape of the heat to the outside as is desired. The temperature of the products of combustion in the heater space normally obtaining of approximately 2000° C. is such that the escape of heat may only be prevented to a limited extent so that the external wall of the housing of the heater system radiates heat so intensively that the use of Stirling engines is largely out of the question in small spaces in which workers have to be present.

SHORT SUMMARY OF THE INVENTION

Accordingly one object of the invention is to provide a thermally insulating lining for the housing of the heater systems of a Stirling engine which has such a high insulating effect as regards the high burnt gas temperatures occurring in the heater space that on the outer surface of the housing the radiation is only slightly above normal room temperature.

Briefly, an internal barrier wall made of separate adjacent replaceably mounted insulating elements of ceramic material is arranged in the housing of the heater system so as to be separated from the outer wall thereof. The intermediate space between the outer wall and the inner barrier wall is packed with ceramic insulating material in form of fibrous insulating material and/or loose lump material.

The presence of the multilayer ceramic lining of the housing of the heater system causes the decrease in temperature from the inside to the outside to take place practically in two stages. The inner barrier wall with its ceramic insulating elements acts as a heat shield. Even to the rear of these insulating elements there is a lower temperature than in the heater space. This temperature decreases still further owing to the packing of the intermediate space in the form of fibrous or loose material to such an extent that at those parts of the outer side of the housing of the heater system which are accessible for workers such as service engineers, exposed surfaces will only be at temperatures of under 100° C. Furthermore, owing to the design in accordance with the invention it is now possible to replace any defective parts of the inner barrier wall with a few simple manipulations. This feature is particularly welcome in the case of Stirling engines in vehicles which are being continually stopped and started and in which powerful vibrations might well lead to fracture of the ceramic material.

DRAWINGS

FIG. 7 is a section taken on the line VII—VII of FIG. 4 to show the lining of the heater system shown in FIG. 2.

FIG. 8 shows a section taken through the lining of the heater system of FIG. 2 taken on the line VIII—VIII of FIG. 7.

FIG. 9 shows a modified form of tubes in the lining of FIG. 2 in cross section.

DETAILED DESCRIPTION

Figure 1:
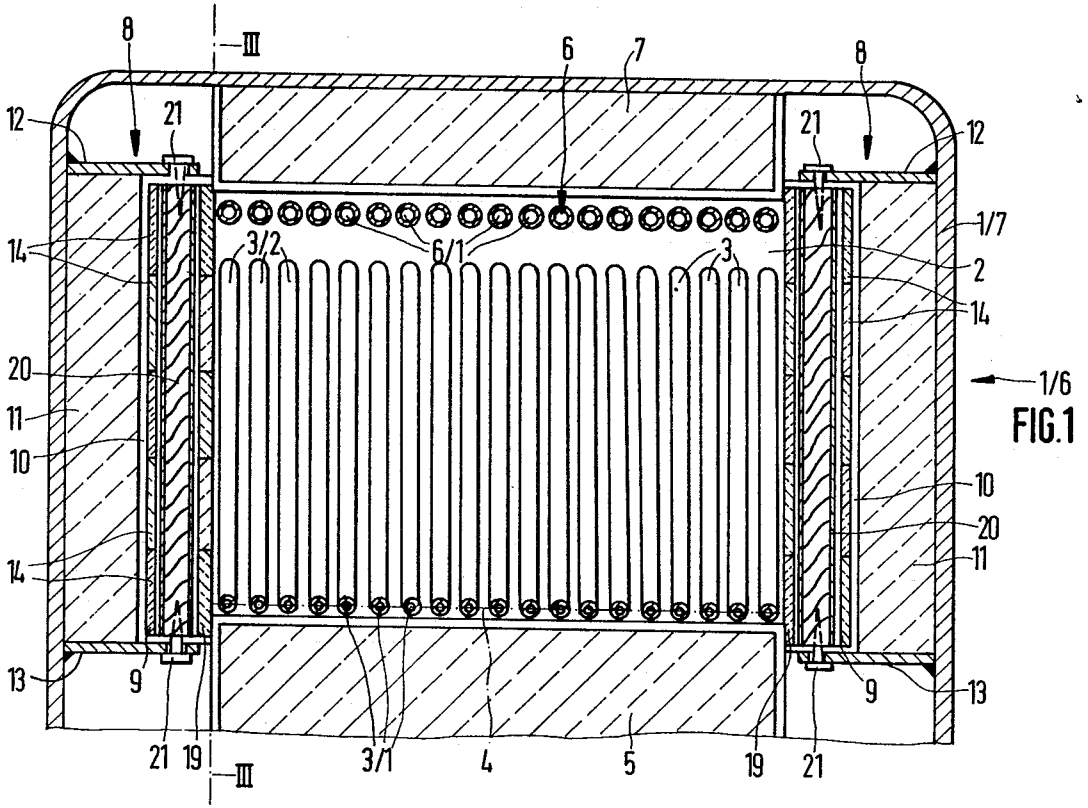
FIG. 1 is a section taken through a Stirling engine in a direction perpendicular to the direction of combustion gas flow so as to show one embodiment of the lining in accordance with the invention.

In the figures like parts are denoted by like reference numerals.

Figure 10:
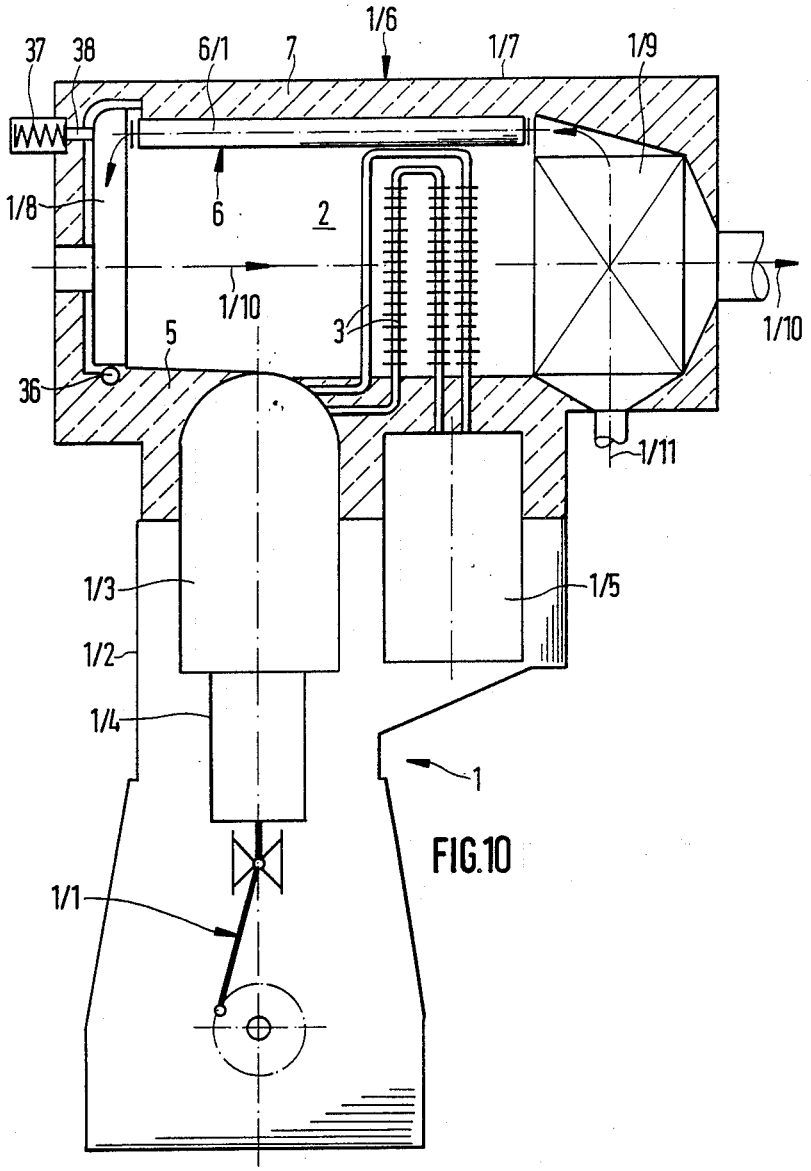
FIG. 10 is a cross section taken through a Stirling engine with cylinders arranged in line.
Figure 11:
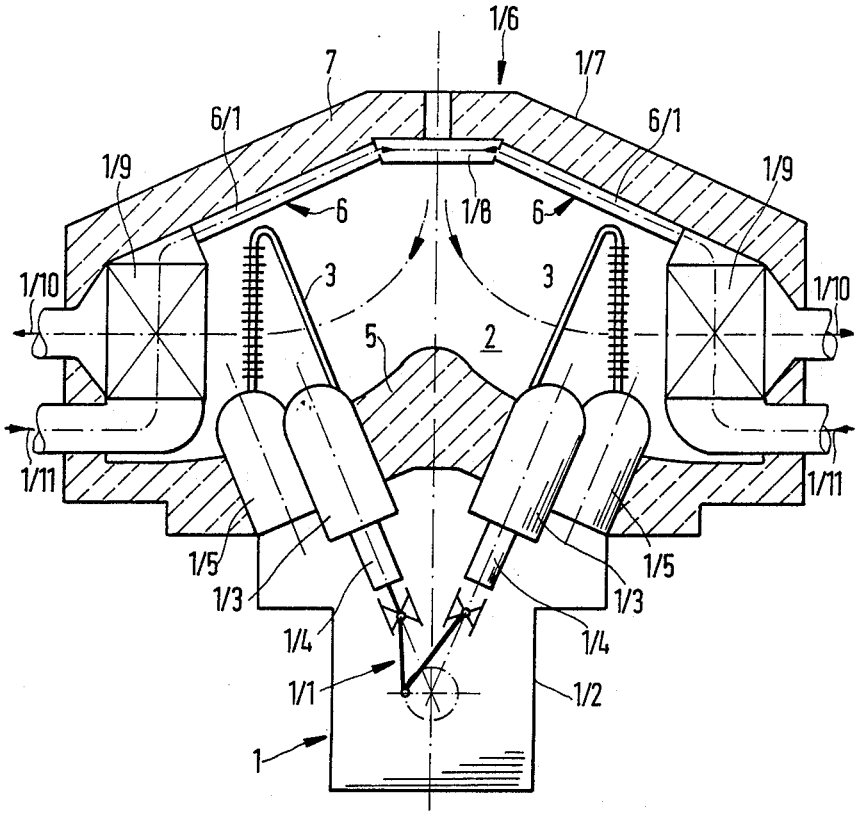
FIG. 11 is a cross section taken through a Stirling engine with a V-engine configuration.

In the Stirling engines 1 shown diagrammatically in FIGS. 10 and 11 12, the power unit 1/1, the engine housing 1/2, the cylinders 1/3 with pistons therein, the piston rod seals 1/4, the regenerator and cooling units 1/5 and the duct means for the working gas are of conventional design. The present invention is primarily concerned on the part with the heater system 1/6, which in effect constitutes the head of the engine 1.

The heater system 1/6 has a housing with an outer wall 1/7, which is internally thermally insulated by a lining. Furthermore the heater system 1/6 comprises at least one burner 1/8 for the production of burnt gas and at least one air preheater 1/9 formed for instance by a single stage or multistage intersecting plate heat exchanger 6 (FIG. 1) for guiding the flow of combustion air. The air preheater 1/9 has both the burnt gases produced by the burner 1/8 it (moving in the direction marked by the arrow 1/10) and also the air (in the direction 1/11) coming from a blower (not shown) flowing through it. The latter air is thus heated.

The burner 1/8 is in the form of a selfcontained assembly conventional for Stirling engines 1 and comprises an air swirling device, an injection device, an ignition device, a combustion chamber, a recirculating device and the like.

The burner 1/8 supplied with air and fuel, as for instance oil or gas, produces burnt gas at a temperature of the order or 2000° C., which in the heater space 2 of limited size produces heat which is initially transferred to the heater tubes 3 for heating for heating the working gas (for instance helium) flowing there through to the working, temperature. Such burnt gas then also gives up heat in the air preheater 1/9 before being finally led off from the heater system 1/6 by means of an exhaust gas pipe.

Figure 2:
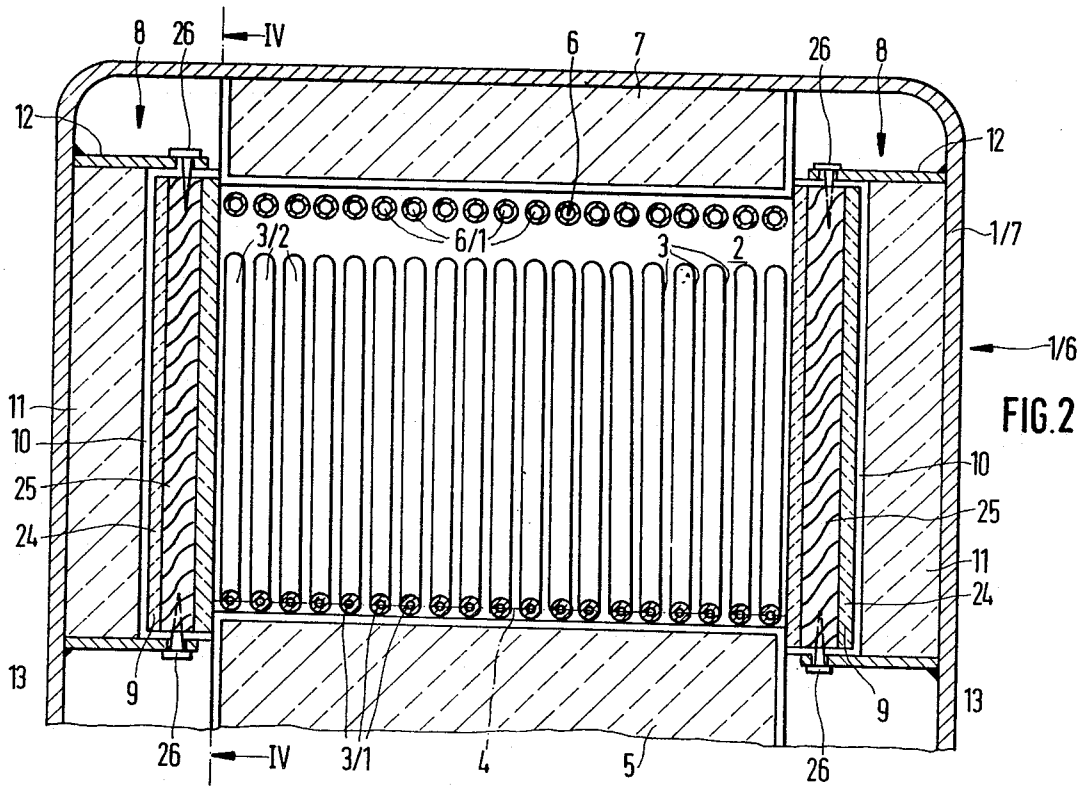
FIG. 2 shows a heater system as in FIG. 1 with a different design of the lining in accordance with the invention.
Figure 4:
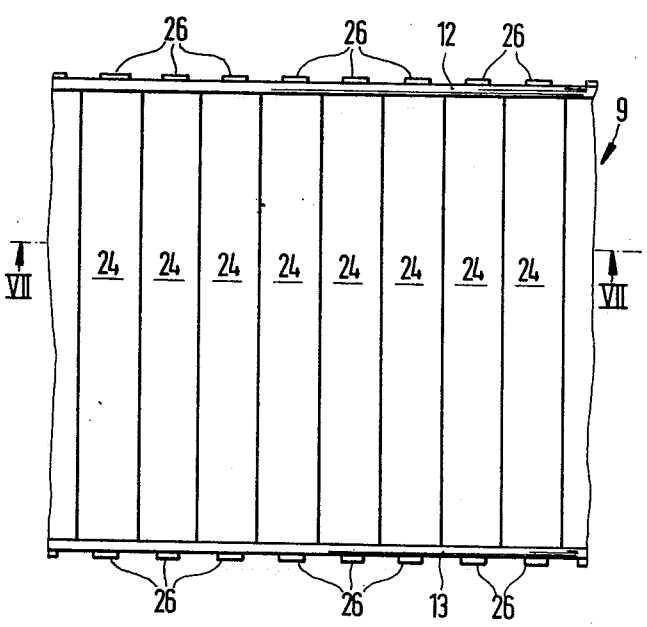
FIG. 4 is a section taken on the line IV—IV of FIG. 2 through the heater system.

The heater tubes 3 are connected in a conventional manner with manifold ducts, which are not shown, and in the design shown in FIGS. 1 and 2 extend from a lower plane (marked by the broken line 4) with parallel sections 3/1 so as to extend into the heater space 2. The heater tubes 3 are bent in V-shape and form where there are U-like spaced and parallel sections 3/2, such sections forming a heater tube wall perpendicular to the direction of the burnt gas flow. In the case of FIG. 11 and there are two such heater tube wall arrays due to the V-like arrangement of two cylinders 1/3 and the associated cooler units 1/5.

The heater space 2 or chamber having the burnt gases flowing through it is closed on all sides to form a burnt gas duct, that is to say at the bottom by a thermally insulating layer 5, not shown in detail, at the top by a device for ducting the combustion air and on the outside and in front of the latter a thermally insulating layer 7 which is contiguous therewith or is spaced at small distance therefrom. On the right and on the left there is an insulating lining 8. Details of this insulating lining 8 will be seen from FIGS. 1 through 9.

In accordance with the invention each lining 8 consists of an inner insulating wall 9 which is arranged in the housing of the heater system 1/6 so as to be spaced from the outer wall 1/7. Wall 9 is made up of adjacent replaceably secured insulating elements of ceramic material. The space between wall 9 and outer wall 1/7 and which is packed with ceramic fiber or lump that is pourable insulating material, filling the 11 an intermediate space between the outer wall 1/7 and the insulating wall 9. An intermediate layer of ceramic paper 10 may be placed in the space.

The internal insulating wall 9 extends between two edge rails 12 and 13 of metal able to resist elevated temperatures and which are attached, e.g. by being welded or screwed, outside the heater space 2, through which the burnt gases flow, to the inner face of the outer wall 1/7. These rails serve both as support rails for the insulating wall 9 and also as the upper and lower limiting wall for the intermediate space charged with insulating material 11.

Figure 3:
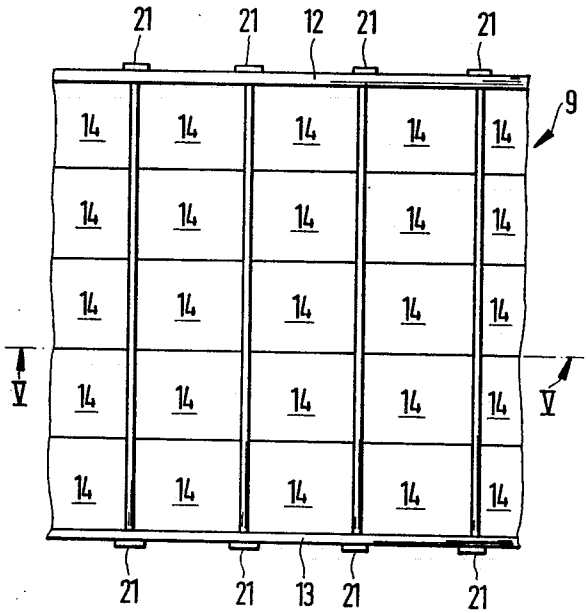
FIG. 3 is a section taken on the line III—III of FIG. 1 through the heater system.
Figure 6:
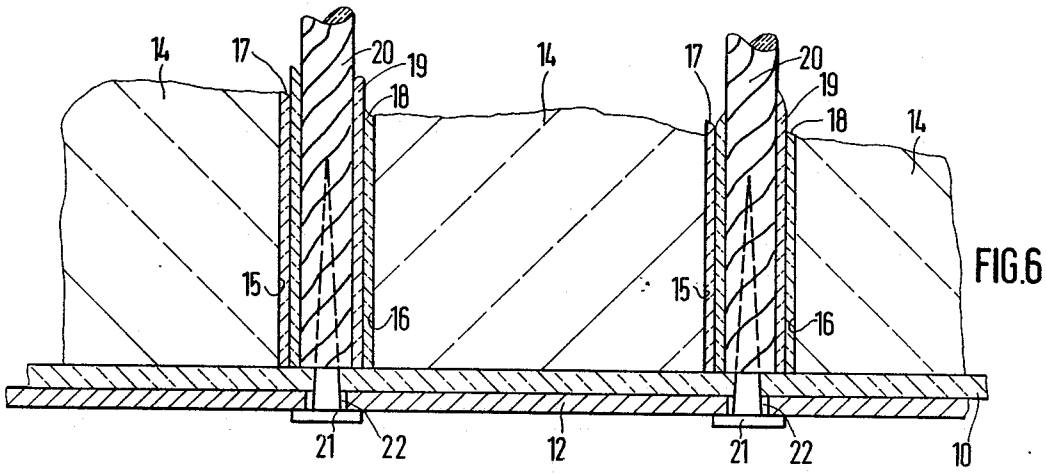
FIG. 6 is a section taken on the line VI—VI of FIG. 5 to show the lining of the heater system of FIG. 1.
Figure 5:
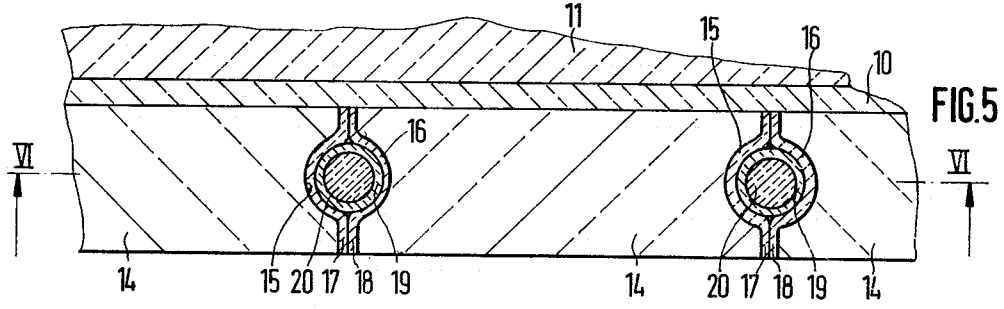
FIG. 5 is a section taken through the lining of the heater system of FIG. 1 taken on the line V—V of FIG. 3.

In the case of FIG. 1 the inner insulating wall 9 of the lining 8 is formed by a plurality of rectangular ceramic tiles 14 or plates, which as may be seen in detail in FIGS. 3, 5 and 6, have grooves 15 and 16 with a generally semi-circular cross section, longitudinal sides so that they are supported by way of these grooves 15 and 16, possibly with the interposition of ceramic paper layers 17 and 18, on ceramic tubes or pipes 19. These ceramic pipes 19 extend between the two edge rails 12 and 13 and are detachably joined thereto at their ends. In accordance within an especially advantageous feature of the invention each of the ceramic tubes 19 may be packed with continuous ceramic packing 20 in rope or string form to ensure that, in the event of one of the tubes 19 fracturing, the fragments thereof and ceramic tiles 14 adjacent thereto do not drop into the heater space 2 (see FIGS. 5 and 6). The attachment of the ceramic tubes 19 is by means of steel or rails 12 and 13, exactly matching position of the tubes. The nails are driven into the end rails 12 and 13 exactly matching the tube layers extend at the end into the space in the tubes and more particularly are driven into the packing 20. The ceramic plates or tiles 14 have a thickness of for instance 30 mm; the associated ceramic tubes 19 have an external diameter of approximately 18 mm.

In the case of the design shown in FIG. 2, the internal insulating wall 9 of the lining 8 is formed by a layer of ceramic tubes 24 arranged to directly abut against each other (FIGS. 7 and 8) an intermediate layer of ceramic paper strip 23 (FIG. 9 may be used). Such tubes also have a packing 25 of ceramic tow and also extend between the two edge rails 12 and 13 and terminally are detachably joined to one of the latter by means of steel or ceramic nails 26. These nails 26 extend through holes 27 predrilled in the edge rails 12 and 13 with a spacing corresponding to the tube spacing and into the packing 25. The ceramic tubes may have the cross section of a circular ring as shown in FIGS. 7 and 8 or generally the cross section of a rectangle see tubes 24' with a groove 28 along one longitudinal side and a marginal bead 29 on the opposite side, adapted to fit into the groove in the adjacent tube, see FIG. 9. The diameter of the thickness of these ceramic tubes 24 is for instance 35 mm.

The insulating material 11 (FIGS. 1, 2) in the space between the outer wall 1/7 and the inner insulating wall 9 may be in the form of a non-woven batt of ceramic fibers or loose lump material made up of fragments of ceramic fibers, fragments of ceramic tiles or ground ceramic material. The proportion of air and thus the insulating effect of this layer may be suitably adjusted by selecting the density of the batt or of the fragments respectively. The thickness of this outer layer of insulating material 11 is equal to 2 to 4 times the thickness of the inner insulating wall 9.

If non-woven batt is used as an insulating material 11 it is possible to do without the intermediate layer of ceramic paper 10 next to the inner insulating wall 9, whereas if loose lump material is used as the insulating material 11 such a ceramic paper layer 10 is expedient inasmuch as the latter will be kept in place in the event of an exchange of a broken part of the inner insulating wall 9 and thus in the interior space, between the latter and the outer wall 1/7.

What is claimed:

1. The combination of a hot gas engine (1) with a hot gas heating system (1/6), said combination, at least in part, having an outer wall (1/7) surrounding the hot gas heating system (1/6) and an inner, heat insulating lining therefore, wherein said heat insulating lining includes an inner insulating wall (9), spaced from the outer wall (1/7), said insulating wall (9) comprising a plurality of replaceably retained insulating elements (14, 19, 24) of ceramic material; and ceramic heat insulating material (11) including at least one of: batts, and loose lump material filling the space between the outer wall (1/7) and said replaceably retained insulating elements forming the inner wall (9).

2. The combination of claim 1 wherein said inner insulating wall (9) further comprises two edge strips or rails (12, 13) of heat resistant metal secured to the inside of the outer wall (1/7) said insulating elements being retained on said strips or rails.

3. The combination of claim 2 wherein said strips or rails project interioriorlly of said outer wall to form a separating wall for said space between the outer wall (1/7) and said inner insulating wall (9).

4. The combination of claim 1 wherein said replaceably retained insulating elements comprises a plurality of ceramic tubes or pipes (24).

5. The combination of claim 2 wherein said strips or rails are located spaced from each other and form terminal holding elements for said insulating element and wherein said insulating elements comprise ceramic tubes or pipes (24) located adjacent each other and extending between the spaced strips or rails (12, 13).

6. The combination of claim 5 further including a ceramic paper layer separating adjacently located tubes or pipes.

7. The combination of claim 1 wherein said insulating elements (14) comprise a plurality of adjacently located ceramic plates (14), said plates being formed with longitudinal grooves (15, 16);

and wherein said ceramic insulating elements (14) further comprise a plurality of ceramic tubes or pipes (19) positioned in the grooves and retaining adjacent ones of said ceramic plates (14).

8. The combination of claim 7 further including a ceramic paper layer (17, 18) positioned between the ceramic tubes or pipes (19) and the wall of the grooves (15, 16) in the ceramic plates.

9. The combination of claim 2 wherein said strips or rails (12, 13) are located spaced from each other and form terminal holding elements for said ceramic insulating elements (14);

wherein said insulating elements (14) comprise a plurality of adjacently located ceramic plates (14), said plates being formed with longitudinal grooves (15, 16);

and wherein said ceramic insulating elements further comprise a plurality of ceramic tubes or pipes (19) positioned in the grooves and retaining adjacent ones of said ceramic plates (14);

said ceramic plates (14) and said ceramic tubes or pipes (19) extending between the spaced strips or rails.

10. The combination of claim 9 further including a ceramic paper layer (17, 18) positioned between the ceramic tubes or pipes (19) and the wall of the grooves (15, 16) in the ceramic plates.

11. The combination of claim 4 wherein the ceramic tubes or pipes define a hollow interior; and a ceramic rope or tow (20) is provided, located in said hollow interior and essentially filling said hollow interior.

12. The combination of claim 1 wherein said replaceably retained insulating elements comprises a plurality of ceramic tubes (24) defining a hollow interior; and a ceramic rope or tow (20) is provided, located in said hollow interior and essentially filling said hollow interior said rope or tow extending essentially to the ends of the hollow tubes or pipes.

13. The combination of claim 7 wherein the ceramic tubes or pipes define a hollow interior; and a ceramic rope or tow (20) is provided, located in said hollow interior and filling said hollow interior.

14. The combination of claim 2 wherein said strips or rails are located spaced from each other and form terminal holding elements for said insulating elements and wherein said insulating elements comprise ceramic tubes or pipes (24) located closely adjacent each other and extending between the spaced strips or rails (12, 13) and forming said inner insulating wall.

15. The combination of claim 5 further including movable attachment projections (21, 26) extending into the interior of the tubes or pipes (24) and attaching the tubes or pipes to the strips or rails (12, 13), said strips or rails being formed with openings through which said attachment projections are passed, to provide for releasable attachment of the tubes or pipes to the strips or rails.

16. The combination of claim 9 further including movable attachment projections (21, 26) extending into the interior of the tubes or pipes (24) and attaching the tubes or pipes to the strips or rails (12, 13), said strips or rails being formed with openings through which said attachment projections are passed, to provide for releasable attachment of the tubes or pipes to the strips or rails.

17. The combination of claim 15 wherein said attachment projections comprise nails (21, 26) of high temperature resistant material, releasably passing through said openings and into the interior of said tubes or pipes;

and ceramic ropes or tows filling the interior of said tubes, said nails passing into said ropes or tows.

18. The combination of claim 16 wherein said attachment projection comprise nails (21, 26) of high temperature resistant material, releaseably passing through said openings and into the interior of said tubes;

and ceramic ropes or tows filling the interior of said tubes, said nails passing into said ropes or tows.

19. The combination of claim 1 wherein said inner insulating wall (9) has a thickness of between about 30 to 40 mm, and the space between the outer wall (1/7) and the inner insulating wall (9), filled with said ceramic heat insulating material (11), has a thickness which is between about two to four times the thickness of the inner insulating wall (9).

20. The combination of claim 1 further including an intermediate layer of ceramic paper (10) positioned between the inner insulating wall (9) and the ceramic heat insulating material (11) filling the space between the outer wall (1/7) and the inner insulating wall (9).

* * * * *